US005150768A

United States Patent [19]

Olson et al.

[11] Patent Number: 5,150,768

[45] Date of Patent: Sep. 29, 1992

[54] LOAD LIMITING APPARATUS FOR A HOIST

[75] Inventors: Wayne L. Olson, Central Point, Oreg.; Gary E. Choate, Lakewood, Colo.

[73] Assignee: Rose Manufacturing Company, Englewood, Colo.

[21] Appl. No.: 770,540

[22] Filed: Oct. 3, 1991

Related U.S. Application Data

[63] Continuation-in-part of Ser. No. 605,240, Oct. 29, 1990, Pat. No. 5,090,507.

[51] Int. Cl.[5] ..... A62B 1/10

[52] U.S. Cl. ..... 182/234; 182/3; 254/346

[58] Field of Search ..... 182/234, 239, 235, 3; 254/364, 365, 369, 348, 346, 372

[56] References Cited

U.S. PATENT DOCUMENTS

| | | | |
|---|---|---|---|
| 1,453,227 | 4/1923 | Murray | 254/346 |
| 2,990,131 | 6/1961 | Carlsson | 182/239 X |
| 4,304,372 | 12/1981 | Smith | 254/346 X |
| 4,489,919 | 12/1984 | Ostrobrod | 254/346 |
| 4,511,123 | 4/1985 | Ostrobrod | 182/234 X |
| 4,589,523 | 5/1986 | Olson | 182/234 |
| 4,602,699 | 7/1986 | Matt | 182/234 |
| 4,603,759 | 8/1986 | Hamada | 182/234 |
| 4,623,038 | 11/1986 | Stancato | 182/239 |
| 4,736,929 | 4/1988 | McMorris | 254/346 X |

FOREIGN PATENT DOCUMENTS

| | | | |
|---|---|---|---|
| 2421139 | 11/1979 | France | 254/346 |

*Primary Examiner*—J. Franklin Foss

*Attorney, Agent, or Firm*—Klaas, Law, O'Meara & Malkin

[57] ABSTRACT

Apparatus for limiting the amount of force applied to a cable of a hoist by applying a force on clutch plates which are operatively joined to rotatable plates so that there is relative rotation between the clutch plates and the rotatable place when a force, equivalent to that placed on the clutch plates, is placed on the load supporting end of the cable. A fall arresting device is also provided having arresting apparatus for applying a force to rotate a shaft in a clockwise direction and for permitting controlled rotation of the shaft in a counter-clockwise direction but arresting uncontrolled rotation of the shaft in a counter-clockwise direction.

20 Claims, 6 Drawing Sheets

LOAD LIMITING APPARATUS FOR A HOIST

This application is a continuation-in-part application of U.S. patent application Ser. No. 605,240 filed Oct. 29, 1990, for Load Limiting Apparatus For A Hoist now U.S. Pat. No. 4,090,507.

FIELD OF THE INVENTION

The invention relates generally to apparatus for raising, lowering or positioning personnel or materials using a hoist and more particularly to apparatus for placing a load limit on the cable of the hoist and to fall arresting apparatus.

BACKGROUND OF THE INVENTION

Various types of apparatus are in use for lowering, raising and positioning personnel or materials at locations which are not readily accessible. Also, many times the personnel or materials are not visible to the operator of the apparatus for the raising, lowering and positioning of the personnel or materials. Therefore, it is desirable to limit the amount of force placed on personnel in the event that they encounter an obstacle when they are being raised. Also, it is desirable to limit the load that can be placed on the cable to prevent injury to the operator. Another desirable feature for the apparatus of this type is to provide for arresting the fall of personnel in the event that there is a failure in the portion of the apparatus applying a force on the cable of the apparatus.

BRIEF DESCRIPTION OF THE INVENTION

This invention provides apparatus for limiting the load that can be placed on line means, such as a cable, of a hoist and for arresting the fall of personnel attached to such line means.

In a preferred embodiment of the invention, the apparatus for limiting the amount of force that can be placed on the line means of a hoist comprises a housing that is mounted at a fixed location which housing has a fixed axle on which a drum having line means, such as a cable, wound thereon is rotatably mounted. The mounting means for rotatably mounting the drum on the axle include clutch means for rotation with the drum and for applying a force to rotate the drum. Rotatable means are operatively connected to the clutch means to rotate the clutch means. Drive means are provided for rotating the rotatable means. Force applying means are provided for applying a force on the clutch means and rotatable means to provide for relative rotation between the clutch means and the rotatable means when a force, substantially equivalent to the force applied by the force applying means, is placed on a load supporting device connected to the line means.

In a preferred embodiment of the invention, the mounting means comprise a hollow rotatable axle that is mounted on the fixed axle for rotation relative thereto. The hollow rotatable axle has an enlarged head portion, a middle portion having a generally rectangularly shaped transverse cross-sectional configuration having four rounded corners and an end portion having at least one threaded portion. A first pressure plate is mounted on the rotatable axle. The pressure plate has an opening formed therein which opening has a generally rectangularly shaped cross-sectional configuration for permitting axial movement thereof over the middle portion and into contacting relationship with the enlarged head portion to limit the axial movement of the first pressure plate and for rotation with the middle portion. A first clutch plate has an opening formed therein, which opening has a generally rectangularly shaped transverse cross-sectional configuration. The first clutch plate is mounted on the middle portion for rotation therewith and for permitting axial movement of the first clutch plate over the rotatable axle. The first clutch plate is in contacting relationship with the first pressure plate. A first rotatable plate has an opening formed therein, which opening has a transverse cross-sectional configuration that is larger than the transverse cross-sectional configuration of the middle portion to permit rotation of the first rotatable plate relative to the middle portion. The first rotatable plate is in contacting relationship with the first clutch plate. A second clutch plate has an opening formed therein, which opening has a generally rectangularly shaped cross-sectional configuration. The second clutch plate is mounted on the middle portion for rotation therewith and for permitting axial movement of the second clutch plate over the rotatable axle. The second clutch plate is in contacting relationship with the first rotatable plate. A second rotatable plate has an opening formed therein, which opening has a transverse cross-sectional configuration that is larger than the transverse cross-sectional configuration of the middle portion to permit rotation of the second rotatable plate relative to the middle portion. The second rotatable plate is in contacting relationship with the second clutch plate. An annular member, comprising a portion of the drive means, extends radially inwardly therefrom. The annular member has an opening formed therein, which opening has a transverse cross-sectional configuration that is circular and has a diameter that is slightly larger than the diameter between opposite rounded corners of the middle portion to permit rotation of the annular member relative to the middle portion and to function as a centering member. The annular member is in contacting relationship with the second rotatable plate. A third rotatable plate has an opening formed therein, which opening has a transverse cross-sectional configuration that is larger than the transverse cross-sectional configuration of the middle portion to permit rotation of the first rotatable plate relative to the middle portion. The third rotatable plate is in contacting relationship with the annular member. A third clutch plate has an opening formed therein, which opening has a generally rectangularly shaped cross-sectional configuration. The third clutch plate is mounted on the middle portion for rotation therewith and for permitting axial movement of the third clutch plate over the rotatable axle. The third clutch plate is in contacting relationship with the third rotatable plate. A fourth rotatable plate has an opening formed therein, which opening has a transverse cross-sectional configuration that is larger than the transverse cross-sectional configuration of the middle portion to permit rotation of the fourth rotatable plate relative to the middle portion. The fourth rotatable plate is in contacting relationship with the third clutch plate. A fourth clutch plate has an opening formed therein, which opening has a generally rectangularly shaped cross-sectional configuration. The fourth clutch plate is mounted on the middle portion for rotation therewith and for permitting axial movement of the fourth clutch plate over the rotatable axle. The fourth clutch plate is in contacting relationship with the fourth rotatable plate. A second pressure plate is mounted on the rotatable axle and has an opening formed therein which opening has a generally rectangularly shaped cross-sectional configuration for permitting axial movement thereof over the middle portion and for rotation with the middle portion and is in contacting relationship with the fourth clutch plate. Securing means are provided for securing the first, second, third and fourth rotatable plates to the annular member for rotation therewith. Connecting means are provided for connecting at least a portion of one of the end walls to the second pressure plate for rotation therewith. The force applying means act on the portion of the one end wall to move the end wall into contacting relationship with the second pressure plate to apply the force on the fourth clutch plate, the fourth rotatable plate, the third clutch plate, the third rotatable plate, the annular member, the second rotatable plate, the second clutch plate, the first rotatable plate, the first clutch plate, the first pressure plate and the enlarged head portion to hold them in the contacting relationship.

A first fall arresting device is mounted on the housing and is of the type illustrated in U.S. Pat. No. 4,589,523 which is incorporated herein by reference thereto. If a worker falls, the movement of the line means is stopped by the fall arresting device. In addition, the relationship between the clutch plates and the rotatable plates will limit the amount of the load that can be placed on the worker. Once the load on the line means is less than the force applied by the force applying means, the fall of the worker will be stopped.

A second fall arresting apparatus is provided and comprises a force applying member that is threadedly mounted on the fixed axle and has a plurality of circumferentially spaced apart abutments formed thereon. A deformable washer is mounted for slidable movement on the fixed axle and is located between the force applying member and a portion of the housing surrounding the fixed axle. At least one pawl is pivotally mounted on one of the end walls of the drum so that the at least one pawl rotates with the drum. The pawl has an abutment end for engagement with one of the plurality of abutments. The pawl has a center of gravity located so that rotation of the drum at a sufficiently great velocity will pivot the pawl so that the abutment end will move into contact with one of the plurality of abutments to rotate the force applying member. The rotation of the force applying member moves the force applying member toward the portion of the housing surrounding the axle to deform the deformable washer until rotation of the drum is stopped.

A third fall arresting apparatus is provided and comprises a shaft mounted at a relatively fixed axial location to permit rotation thereof in a clockwise direction or a counter-clockwise direction. Drive means are mounted for movement in one direction to rotate the shaft in one of the clockwise or counter-clockwise directions and are moved by detachable operating means when attached thereto. Holding means are provided for preventing movement of the drive means in the opposite direction of the one direction. Arresting means are provided for arresting the rotation of the shaft in a direction opposite to the one direction of the clockwise or counter-clockwise directions and control means are provided for automatically operating the arresting means when the detachable operating means have been detached from the drive means. Coupling means are provided for coupling together the arresting means and the drive means to move the drive means in the one direction. The arresting means comprise an annular member having a longitudinal axis and mounted on the shaft for permitting rotational movement therebetween. An internal shoulder is formed on the annular member and at least one pin projects axially outwardly from the annular member for rotation therewith. One end portion of the shaft has an externally threaded portion and a hollow member having an internally threaded portion is threaded onto the externally threaded portion of the shaft. The hollow member has a radially outwardly directed flange portion having at least one opening formed therein for receiving at least a portion of the at least one pin so that the hollow member and the annular member rotate together. The hollow member has an annular recess formed in one end surface and resilient means, in contact with the annular recess and the internal shoulder, urge the annular member into contact with the drive means. The drive means comprise a backup plate on the shaft for rotation therewith, a first friction pad mounted on the shaft for permitting relative rotational movement therebetween, a ratchet wheel mounted on the shaft for permitting relative rotational movement therebetween and located so that the first friction pad is located between the ratchet wheel and the backup plate and a second friction pad mounted on the shaft for permitting relative rotational movement therebetween and located between the ratchet wheel and the annular member so that the annular member, in response to the force applied thereto by the resilient means, moves facing surfaces of the annular member, the second friction pad, the ratchet wheel, the first friction pad and the backup plate into contacting pressurized relationship so that further rotation of the arresting means rotates the drive means. Connecting means are provided for detachably connecting the operating means to the hollow member to rotate the hollow member in the one of the clockwise or counter-clockwise directions so that rotation of the hollow member by the operating means moves the hollow member in an axially inward direction over the shaft to increase the pressurized relationship so that the drive means rotates with the hollow member. The connecting means also permit the operating means to rotate the hollow member in a direction opposite the one of the clockwise or counter-clockwise directions to move the hollow member in an axially outward direction over the shaft to permit rotational movement of the shaft in the opposite direction.

A safety stop is provided near the end of the line means on the drum. The line means are wound on the center portion of the drum so that portions of the line means form a plurality of rows on the center portion of the drum. Deformable means join together two adjacent turns of the line means forming the first row of the drum next adjacent to the center portion. The deformable means will hold the two adjacent turns together to a limit when the deformable means break.

Another fall arresting device is provided and comprises a shaft mounted at a fixed axial location to permit rotation thereof in a clockwise or counter-clockwise direction. Drive means are mounted for rotating the shaft in one of the clockwise or counter-clockwise directions. Holding means are provided for preventing rotation of at least a portion of the drive means in the opposite of the one of the clockwise or counter-clockwise directions. Arresting means are provided for permitting controlled rotation of the drive means in the opposite of the one of the clockwise or counter-clockwise directions but arresting uncontrolled rotation of the drive means in the opposite of the clockwise or counter-clockwise directions. Control means are mounted for axial movement on the shaft for automatically controlling the operation of the arresting means.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
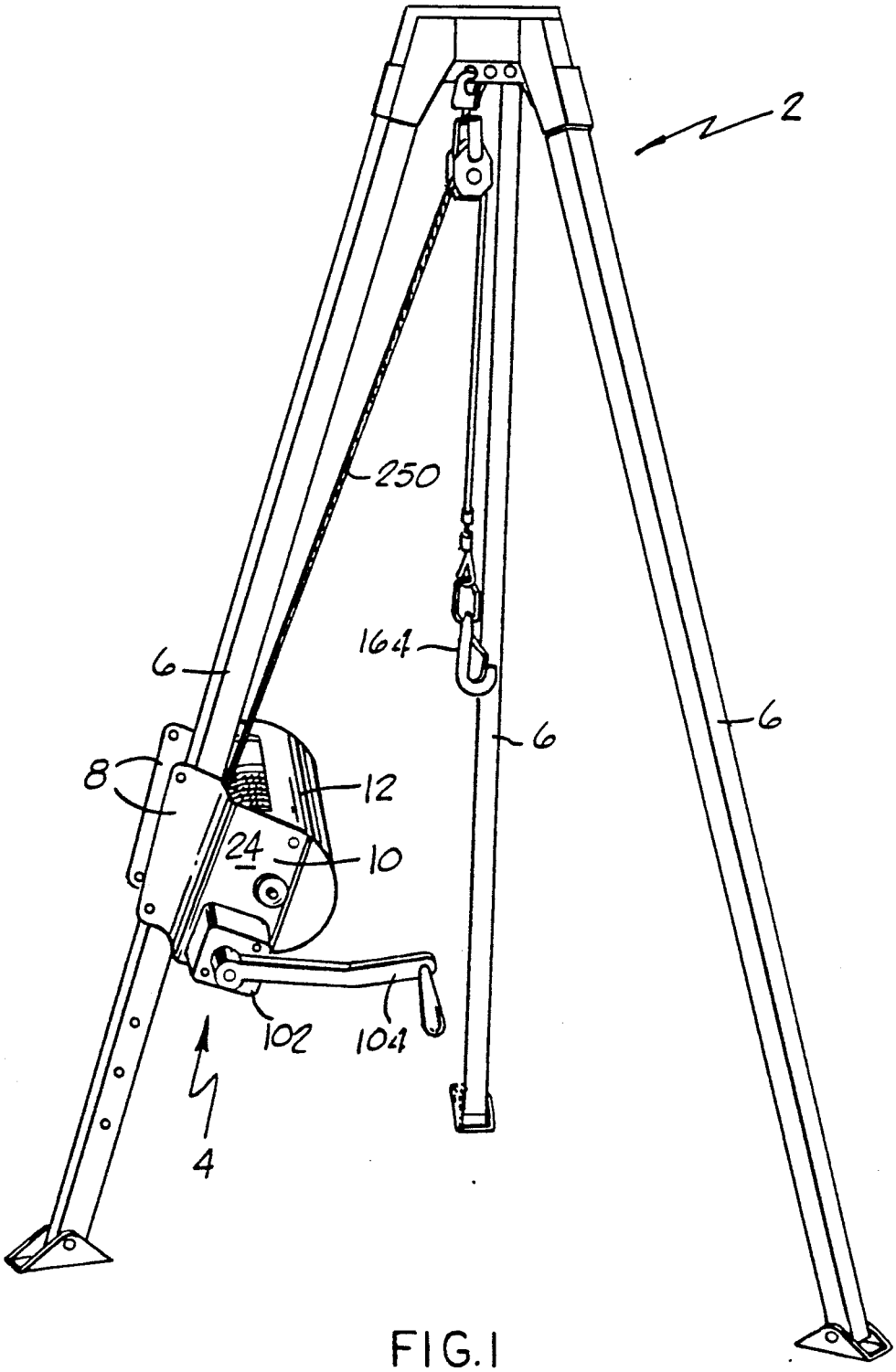
FIG. 1 is a perspective view of a conventional tripod anchorage with a hoist of this invention mounted thereon.

In FIG. 1, there is illustrated a conventional tripod anchorage 2 such as that marketed by Rose Manufacturing Company under the trade designation "ROPOD". The apparatus 4 of this invention is mounted on one of the legs 6 of the tripod anchorage 2 using flange portions 8 of the housing 10. A cover 12 is secured on the housing 10.

In FIGS. 2–6, there is illustrated the mounting means for mounting the apparatus 4. The housing 10 comprises a base 20 and two opposite sidewalls 22 and 24 in addition to the flange portions 8. A fixed axle 26 having an enlarged head portion 28 passes through an opening 30 in the sidewall 22 and through an opening 32 in a support member 34 which is threaded into an opening 35 in the sidewall 24. A nut 36 is in threaded engagement with the threaded end portion 38 of the axle 26 and cooperates with the enlarged head portion to mount the fixed axle 26 securely on the sidewalls 22 and 24.

Figure 2:
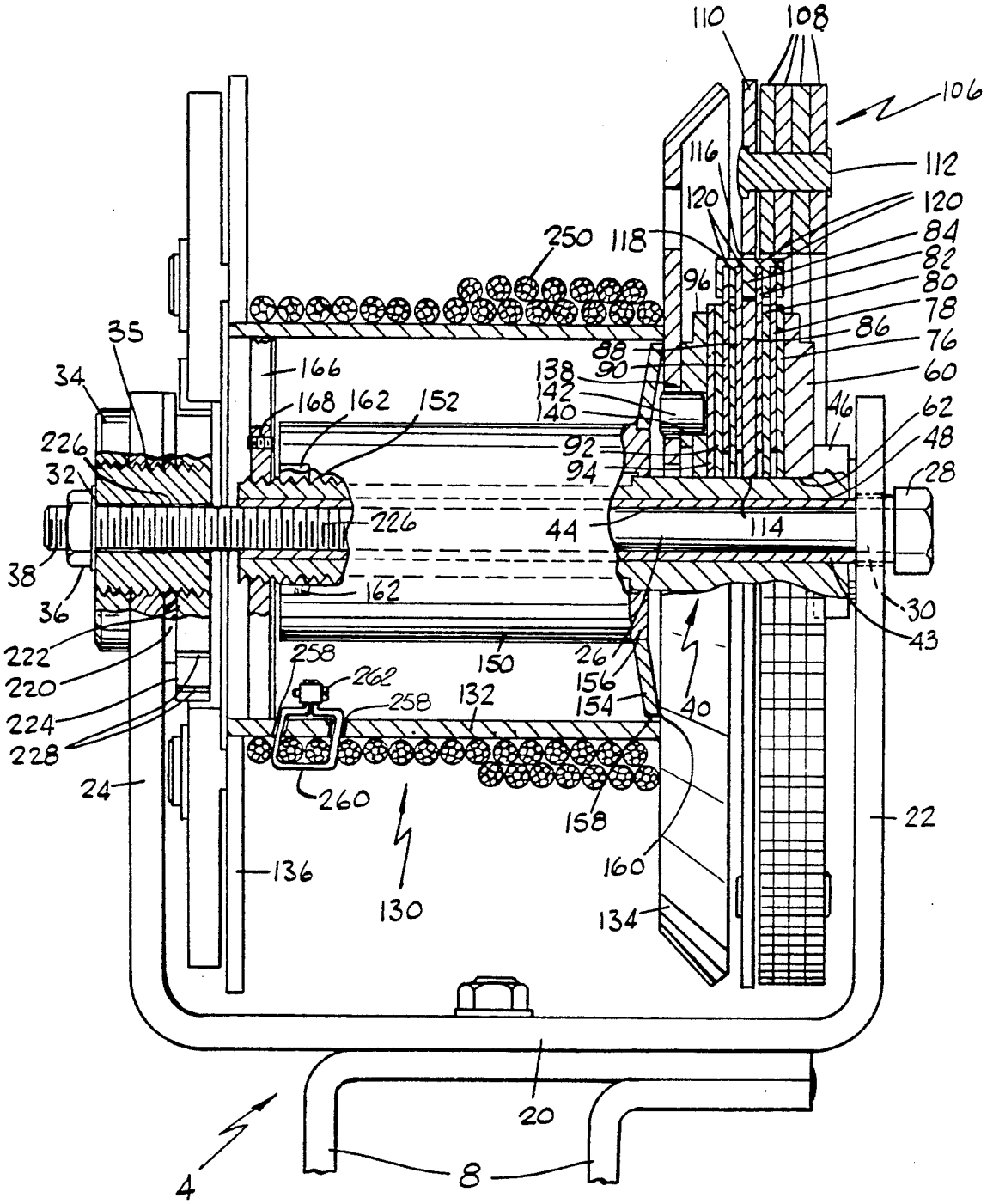
FIG. 2 is an elevational view with parts in section illustrating the invention.
Figure 3:
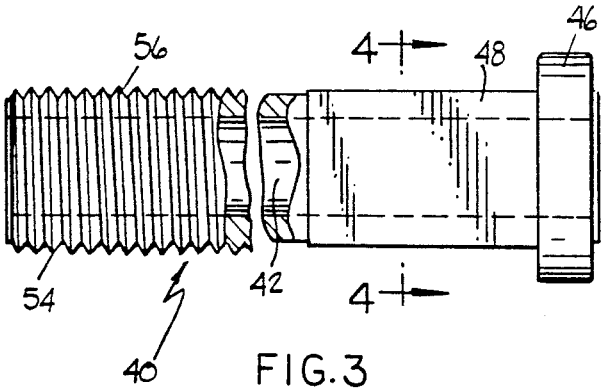
FIG. 3 is an elevational view of the rotatable axle.
Figure 4:
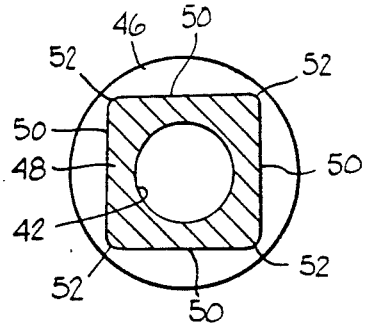
FIG. 4 is a cross-sectional view taken on the line 4—4 of FIG. 3.

A hollow rotatable axle 40, FIGS. 2–4, has a generally cylindrical inner surface 42. A 4140 hardened steel bearing 43 is located between the generally cylindrical inner surface 42 and the generally cylindrical outer surface 44 of the fixed axle 26 so that the hollow rotatable axle 40 can rotate relative to the fixed axle 26. The rotatable axle 40 has an enlarged head portion 46, a middle portion 48 having four linearly extending sides 50 connected by rounded corners 52 to provide the middle portion 48 with a generally rectangularly shaped transverse cross-sectional configuration, preferably a square, having rounded corners and an end portion 54 having external threads 56.

Figure 5:
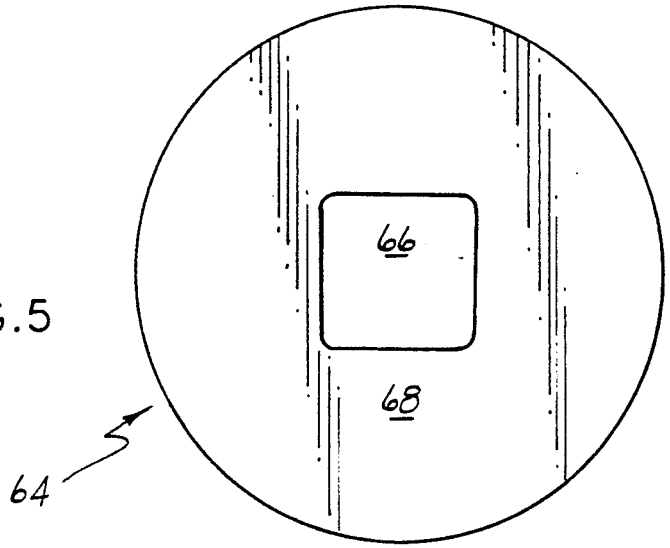
FIG. 5 is an elevational view of a clutch plate.

A first pressure plate 60 has an opening 62 having a generally rectangularly shaped transverse cross-sectional configuration, preferably a square to mate and rotate with the middle portion 48. The first pressure plate 60 is moved over the middle portion 48 and abuts against the enlarged head portion 46. In FIG. 5, there is illustrated a clutch plate 64 having an opening 66 having a generally rectangularly shaped transverse cross-sectional configuration to mate and rotate with the middle portion 48. The clutch plate 64 has oppositely facing generally planar surfaces 68. The clutch plates referred to below are shaped similarly to the clutch plate 64 and are formed from a metallic material such as stainless steel.

Figure 6:
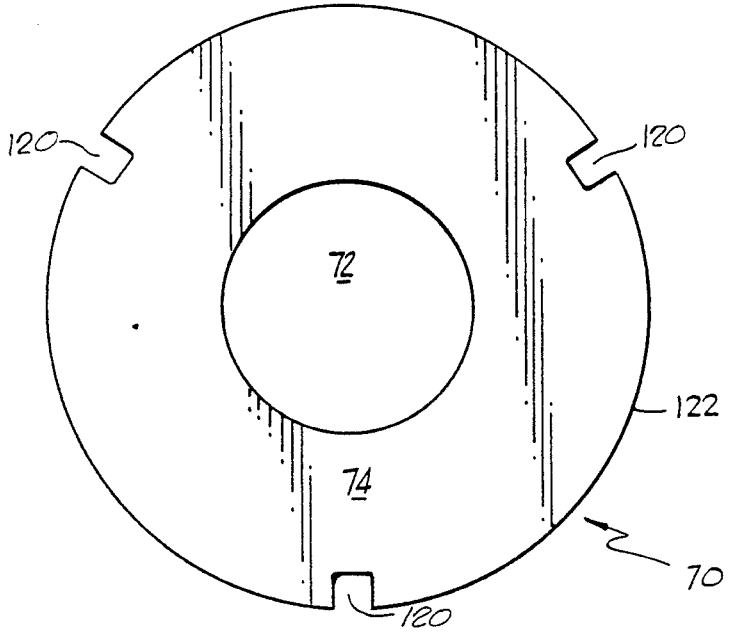
FIG. 6 is an elevational view of a rotatable plate.

In FIG. 6, there is illustrated a rotatable plate 70 having a circular opening 72 having a diameter that is greater than the diameter between opposite rounded corners 52 of the middle portion 48 so that the rotatable plate 70 can rotate relative to the middle portion 48. The rotatable plate 70 has oppositely facing generally planar surfaces 74. The rotatable plates referred to below are shaped similarly to the rotatable plate 70 and are formed from a metallic material, such as brass. In FIG. 2, there is illustrated a first clutch plate 76 in contacting relationship with the first pressure plate 60; a first rotatable plate 78 in contacting relationship with the first clutch plate 76; a second clutch plate 80 in contacting relationship with the first rotatable plate 78; a second rotatable plate 82 in contacting relationship with the second clutch plate 80; and annular member 84, described more fully below, in contacting relationship with the second rotatable plate 82; a third rotatable plate 86 in contacting relationship with the annular member 84; a third clutch plate 88 in contacting relationship with the third rotatable plate 86; a fourth rotatable plate 90 in contacting relationship with the third clutch plate 88; a fourth clutch plate 92 in contacting relationship with the fourth rotatable plate 90; a fifth clutch plate 94 in contacting relationship with the fourth clutch plate 92 and a second pressure plate 96, shaped similarly to the first pressure plate 60, in contacting relationship with the fifth clutch plate 94.

The drive means for the apparatus 4 is illustrated in FIGS. 1 and 2. A fall arresting device of the type described below is located in the housing 102 and has rotatable gear means which are rotated by the crank arm 104 and which are engaged with a gear 106 (FIG. 2) which is formed by a lamination of annular plates 108 and the outer portion 110 of the annular member 84 and held together by a plurality of rivets 112. The annular member 84 has a central opening 114 having a generally cylindrical inner surface that has a diameter slightly greater than the diameter of opposite rounded corners 52 of the middle portion 48 so that the annular member 84 may rotate relative to the middle portion 48. The annular member 84 has a plurality of off center openings 116 formed therein. A pin 118 passes through each of the openings 116 and through a plurality of slots 120 formed in the outer rim portions of the first, second third and fourth rotatable plates 78, 82, 86 and 90 so that they will rotate with the annular member 84 and will be properly located relative to the first through fifth clutch plates 76, 80, 88, 92 and 94 and the first and second pressure plates 60 and 96.

In FIG. 2, there is illustrated a drum 130 having a center section 132 and two end walls 134 and 136 secured to the center section 132 by suitable means such as by welding. The end wall 134 has a plurality of openings 138 which are aligned with similar openings 140 in the second pressure plate 96. A pin 142 is located in the openings 138 and 140 so that the end wall 134 is mounted on the second pressure plate 96 for rotation therewith.

Force applying means are provided and comprise a sleeve member 150 having an internally threaded portion 152 for threaded engagement with the external threads 56 of the rotatable axle 40. A belleville washer 154 is seated in a recess 156 in the sleeve member 150 and the rim portion 158 of the belleville washer bears against a portion 160 of the end wall 134. The sleeve member 150 has flat portions 162 so that a tool may be placed thereon to tighten the sleeve member 150 on the external threads 56. As the sleeve member 150 is tightened onto the external threads 56, it applies a force on the end wall 134 which is transmitted to the first and second pressure plates 60 and 96, the first through the fifth clutch plates 76, 80, 88, 92 and 94, the first through the fourth rotatable plates 78, 82, 86 and 90 and the annular member 84 so that they are clamped together between the enlarged head portion 46 and the belleville washer 154. The amount of force applied by the sleeve member 150 can be varied as desired. In a preferred embodiment of the invention, the sleeve member 150 is tightened so that the rotatable plates 78, 82, 86 and 90 and the clutch plates 76, 80, 88, 92 and 94 rotate together until an equivalent force of 600 pounds is placed on the swivel snaphook 164. Therefore, if a force greater than 600 pounds is placed on the swivel snaphook 164, there will be relative rotation between the rotatable plates 78, 82, 86 and 90 and the clutch plates 76, 80, 88, 92 and 94. If personnel were being lifted by the apparatus 4 and an obstacle blocked their upward movement, the maximum force applied to the personnel would be limited to 600 pounds. If a worker falls, the maximum force placed on the worker would be 600 pounds and would be stopped if the load on the line means is less than 600 pounds. Also, if materials were placed on a platform attached to the swivel snaphook 164 and exceeded 600 pounds, the maximum force placed by an operator on the crank arm 104 would be the 600 pounds so that the platform would not be lifted. After the desired amount of force has been applied by the sleeve member 150, a spanner nut 166 is threaded onto the external threads 56 and moved into contact with the sleeve member 150. A set screw 168 is then tightened to urge the sleeve member 150 and the spanner nut 166 apart to lock them in position on the external threads 56.

Figure 7:
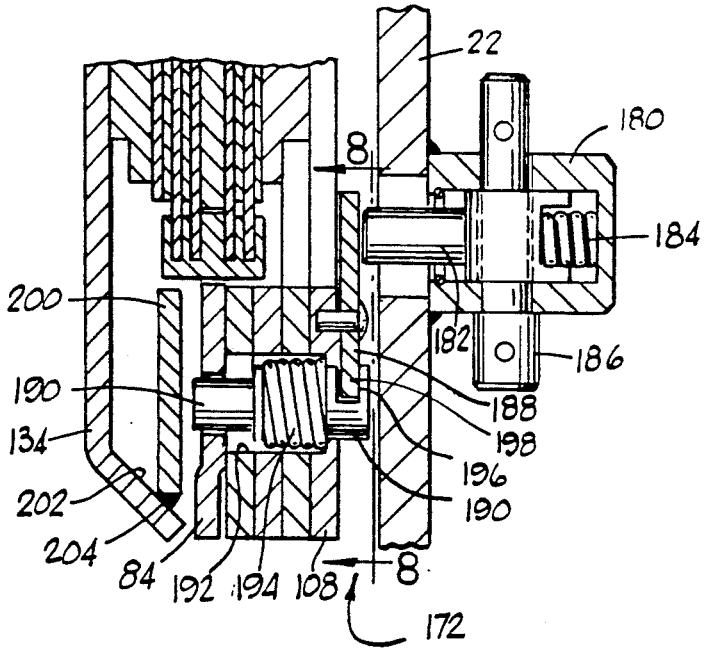
FIG. 7 is an elevational view of emergency apparatus for use with this invention.
Figure 8:
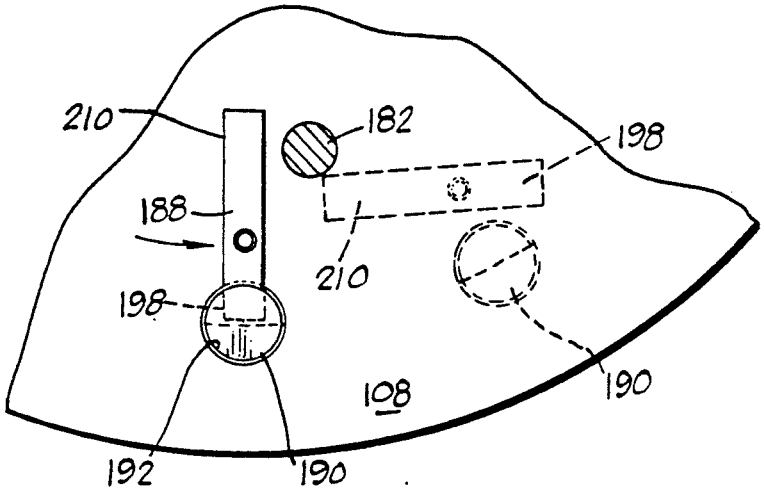
FIG. 8 is a cross-sectional view taken on the line 8—8 of FIG. 7.
Figure 9:
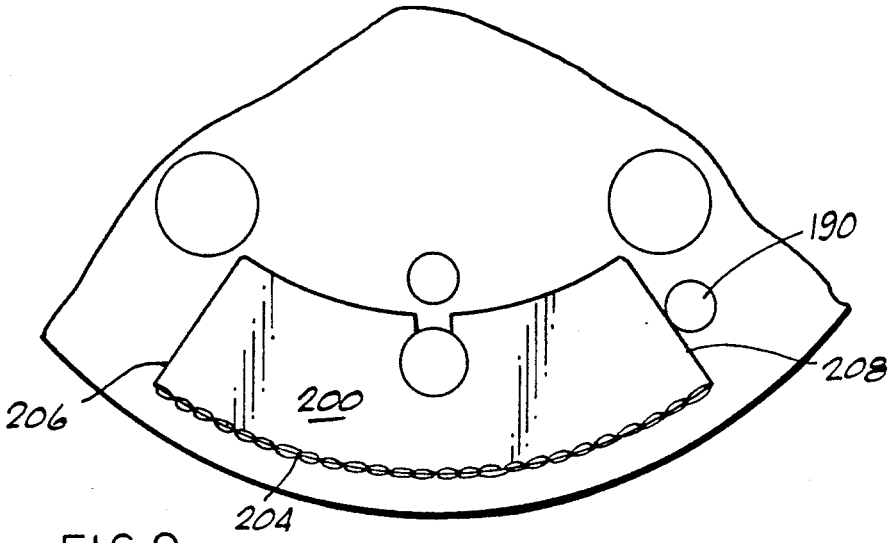
FIG. 9 is an elevational view of a portion of FIG. 8.

In the event of an emergency where it is desired to be able to lift additional weights exceeding the force put on the apparatus 4, emergency apparatus 172 is provided and is illustrated in FIGS. 7-9. A housing 180 is mounted on the sidewall 22. A pin 182 is mounted for sliding movement in the housing 180 and resilient means 184 urge the pin 182 in a direction toward the end wall 134. A stop pin 186 prevents movement of the pin 182. In FIGS. 7 and 8, there is illustrated a lever arm 188 that is pivotally mounted on the outer plate 108 of the gear 106. A pin 190 is mounted for sliding movement through aligned openings 192 in the plates 108 and the annular member 84. Resilient means 194 urge the pin 190 in a direction of the end wall 134. A slot 196 is formed in the pin 190 and a portion 198 of the lever arm 188 is located in the slot 196 to prevent movement of pin 190. In FIGS. 7 and 9, there is illustrated a stop plate 200 that is secured to the surface 202 of the end wall 134 by suitable means, such as by welding 204. The stop plate 200 has opposite end portions 206 and 208 which are located to be contacted by the pin 190. When an emergency situation arises, the stop pin 186 is pulled out. This permits pin 182 to move partially out of the housing 180. As the gear 106 rotates, the end portion 210 of the lever arm 188 contacts the pin 180 and is rotated thereby to move the portion 198 out of the slot 196 to permit movement of the pin 190. The continued rotation of the gear 106 moves the pin 190 against one of the end portions 206 or 208 so that the crank arm 104 can be used to lift or lower any emergency loads.

Figure 10:
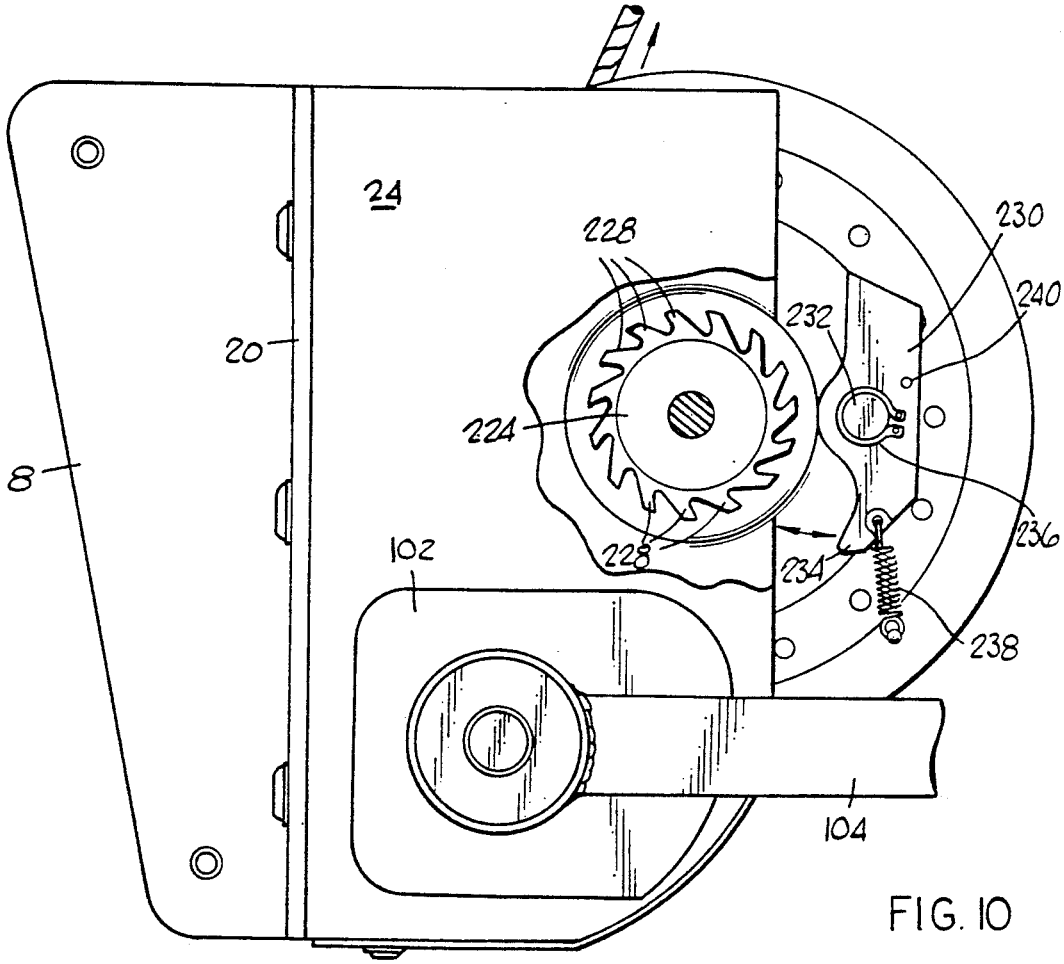
FIG. 10 is a side elevational view with parts removed of the fall arresting apparatus.
Figure 11:
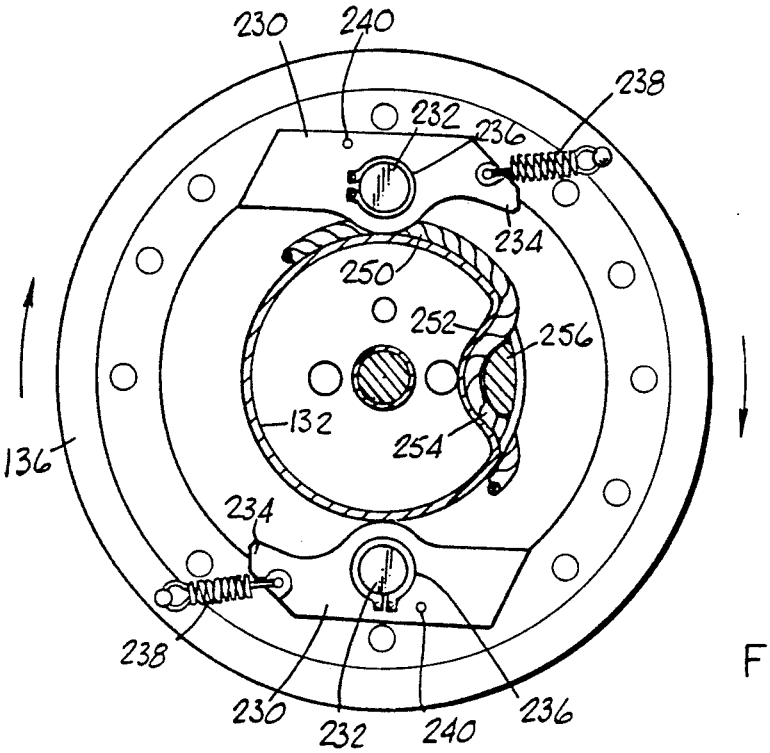
FIG. 11 is a side elevational view showing the attachment of the cable to the drum.

Fall arresting apparatus is illustrated in FIGS. 2, 10 and 11. A plastic washer 220 has a central opening 222 so that it can be positioned on the threaded portion 35. The plastic washer 220 is formed from a deformable plastic material, such as hytrel or urethane. A force applying member 224 has an internally threaded portion 226 that is in engagement with the threaded portion 35. The force applying member 224 has a plurality of circumferentially spaced apart abutments 228 formed thereon. The plastic washer 22 is located between a portion of the sidewall 24 and the force applying member 224. A pair of pawls 230 are pivotally mounted on studs 232 projecting outwardly from the end wall 136. The pawls 230 have abutment end portions 234 adapted to be moved into contact with the abutments 228. Retaining means 236 are used to retain the pawls 230 on the studs 232. Resilient means 238 are used to position the pawls 230 at desired locations. The center of gravity 240 of each pawl 230 is located so that an initial rapid acceleration of the end wall 136 will apply an inertial force on the pawl 230 to urge the abutment end portions 234 in a direction away from the abutments 228. After the initial rapid acceleration has abated, the continued rotation of the end wall 136 will produce a force moving the abutment end portions into contact with the abutments 222. This will apply a force on the force applying member 224 to rotate it on the threaded end portion 38 so that it moves toward the sidewall 24 to deform the plastic washer 220. This will produce a braking effect on the end wall 136 to stop the rotation of the end wall 136.

A safety device is illustrated in FIGS. 1, 2 and 11. One end of the line means 250, such as a 3/16 inch galvanized steel wire rope, has a swivel snaphook 164 attached thereto while the other end thereof (not shown) is connected by conventional means to the end wall 134. The line means 250 are then wound around the center section 132. At a location after about three turns of the line means 250 on the center section 132, a pair of parallel cuts (not shown) are made in the center section 132 and a portion 252, FIG. 11, is pushed inwardly. A portion 254 of the line means 250 is pushed against the portion 252 and a metal rod 256 is passed through the space between the portion 252 and the portions of the center section 132 on each side of the portion 252. At a location at about the thirteenth and fourteenth turns of the line means 250 on the center section 132, a pair of spaced apart holes 258 are made in the center section 132. A strip 260 of metal material, such as stainless steel, is passed around the thirteenth and fourteenth turns and through the holes 258. The ends of the metal strip 260 are joined together by a set screw fastener 62. When the line means 250 had been unwound to the fourteenth turn, the metal strip 260 would function to provide a warning that the end of the line means 250 is near. The strip 260 of metal material will break at about 450 pounds under a dynamic load. If the metal strip 260 breaks, the frictional brake arrests the fall until the cable reaches the metal rod 256.

Figure 12:
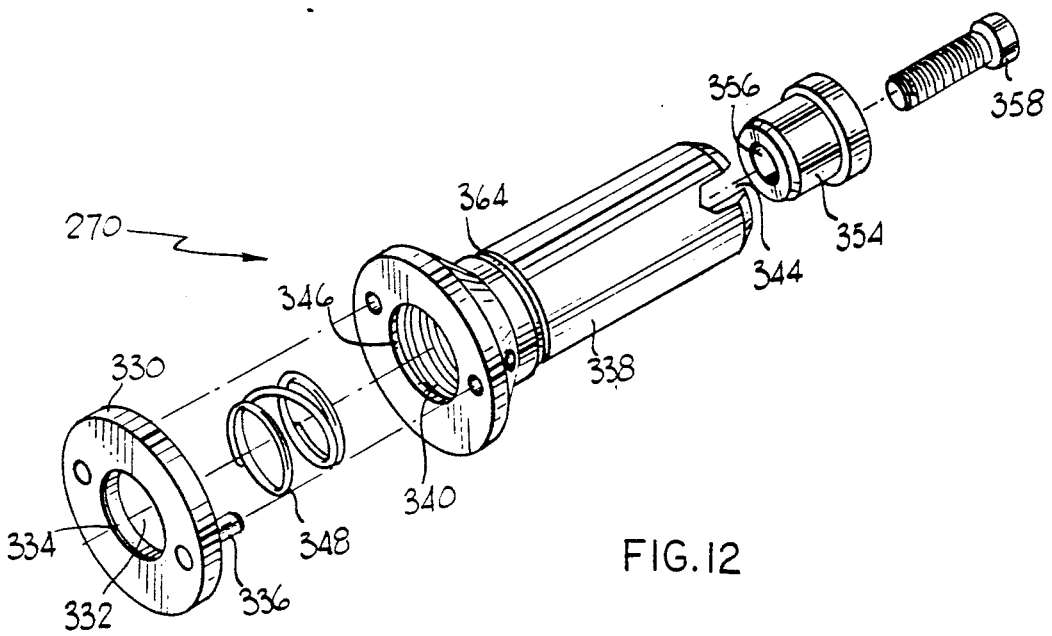
FIG. 12 is an exploded view of a fall arresting apparatus of this invention.
Figure 13:
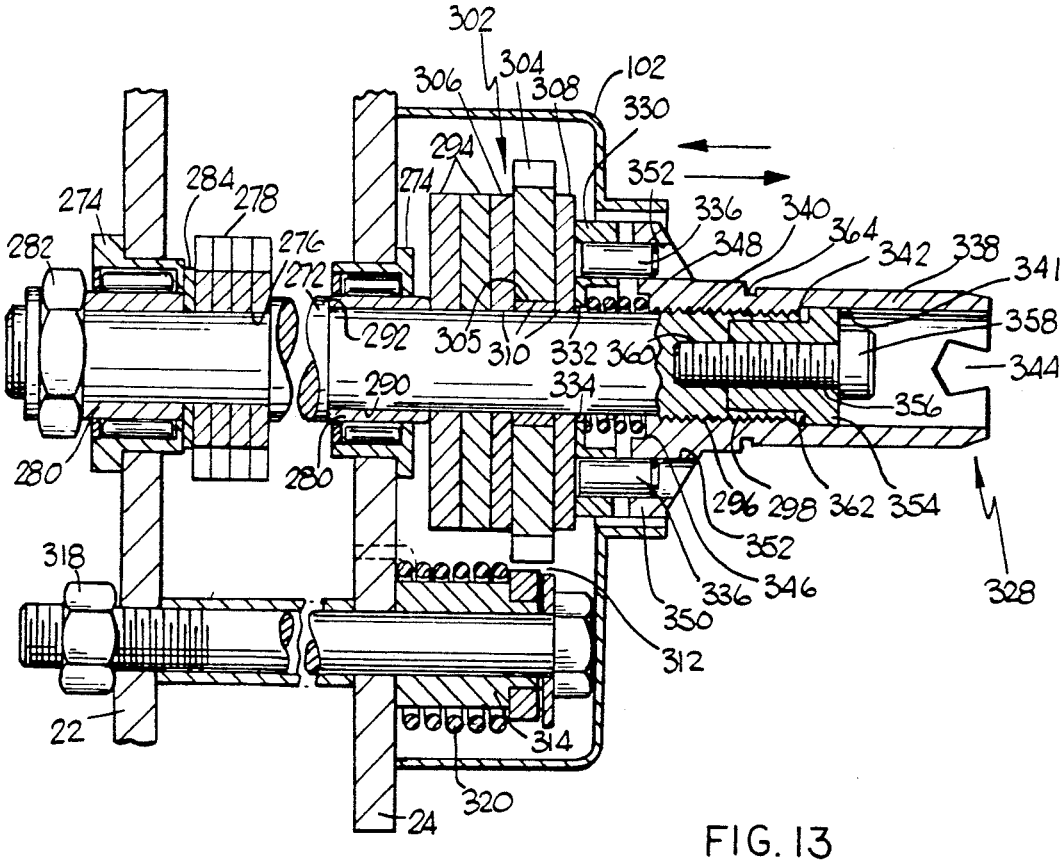
FIG. 13 is an side elevational view with parts in section of the arresting apparatus.

In FIGS. 12 and 13, there is illustrated fall arresting apparatus 270 which is located in the housing 102 and is operatively connected with the apparatus for rotating the gear 106. As illustrated in FIGS. 1 and 13, the housing 102 is mounted on sidewall 24. A shaft 272 is mounted for rotation in a clockwise or counter-clockwise direction in bearings 274 mounted at fixed locations on the sidewalls 22 and 24. The diameter of the shaft 272 is reduced at one end portion 276 thereof and has a laminated gear 278 mounted thereon for rotation therewith. The inner race 280 of the bearing 274 and a lock nut 282 threaded onto the one end portion 276 function to prevent axial movement of the shaft 272. A flat washer 284 is located between the laminated gear 278 and the inner race 280. The laminated gear 278 is in mesh with the laminated gear 106.

The diameter of the shaft 272 is reduced at another end portion 290 so as to form an abutment shoulder 292. The inner race 280 of the bearing 274 abuts against the abutment shoulder 292. A pair of backup plates 294 are secured on the shaft 272 for rotation therewith and a portion thereof is in contact with the inner race 280 of the bearing 274. The another end portion 290 has an externally threaded portion 296 terminating at the end 298 of the another end portion 290.

A drive means 302 is provided for rotating the shaft 272 in either a clockwise or a counter-clockwise direction as viewed from the right side of FIG. 13. The drive means 302 comprise a ratchet wheel 304 which is mounted on a hardened steel bearing 305, a first friction pad 306, a second friction pad 308 and the back-up plates 294. The hardened steel bearing 305 and the first and second friction pads 306 and 308 have central openings 310 having a diameter larger than the diameter of the another end portion 290 to provide for axial sliding movement of the ratchet wheel 304 and the first and second friction pads 306 and 308 over the another end portion 290 and for relative rotation between the ratchet wheel 304, the first and second friction pads 306 and 308 and the another end portion 290. A locking pawl 312 is rotatably mounted on a block 314 which is mounted on the sidewall 24 by a headed threaded bolt 316 passing through openings in the sidewalls 24 and 22 and secured thereto by threaded nut 318. A coil spring 320 mounted on the block 314 applies a force on the locking pawl 312 to urge it into engagement with the teeth on the ratchet wheel 304 to form holding means so that the ratchet wheel 304 can rotate only in the clockwise direction.

The fall arresting device 270 has control means 328 comprising an annular member 330 having a longitudinal axis, a central opening 332 and an internal flange 334 having a diameter greater than the diameter of the another end portion 290 to permit rotational movement therebetween. A pair of circumferentially spaced apart pins 336 project in an axial direction from the annular member 330. A hollow member 338 has an internally threaded portion 340 in threaded engagement with the externally threaded portion 296 and a generally cylindrical surface 341 having a diameter greater than the internally threaded portion to form an internal annular shoulder 342. The hollow member 338 has a pair of circumferentially spaced apart openings 344 so that a tool, such as the crank arm 104 or an air or electric gun, may be inserted therein to rotate the hollow member 338. An annular recess 346 is formed in the hollow member 338. A coiled spring 348 is located between the annular recess 346 and the internal flange 334 to exert a force on the annular member 330 to move it into contacting relationship with the second friction pad 308. The hollow member 338 has an external flange 350 having a pair of circumferentially spaced apart openings 352 adapted to receive the pins 336 so that the annular member 330 rotates with the hollow member 338. A stop member 354 has a central longitudinally extending opening 356 so that a headed threaded bolt 358 may pass therethrough and be threaded into an internally threaded opening 360 in the another end portion 290 to hold the stop member 354 in engagement with the end 298 of the another end portion 290. The stop member 354 has an annular flange 362 adapted to contact the annular shoulder 342 to limit the axial movement of the hollow member 338. The annular flange 362 is spaced an axial distance from the annular shoulder 342 to permit limited axial movement of the hollow member 338. The frictional resistance between the externally threaded portion 296 and the internally threaded portion 340 is less than the frictional resistance between the annular member 330 and the second friction pad 308.

In operation, a crank arm 104 or other similar tool, such as an air or electric gun, is attached to the hollow member 338 which has an external recess 364 for the attachment of an air or electric gun. When the hollow member 338 is rotated in a clockwise direction in FIG. 13, the hollow member 338 moves axially until it contacts the annular member 330. This movement compresses the coiled spring 320 to increase the forces exerted by the annular member 330 on the second friction pad 308; the second friction pad 308 on the ratchet wheel 304; the ratchet wheel 304 on the first friction pad 306 and the first friction pad 306 on the backup plates 294 so that continued rotation of the hollow member 338 rotates the back-up plates 294 to rotate the shaft 272 in a clockwise direction to raise the swivel snaphook 164. When it is desired to lower the swivel snaphook 164, the crank arm 104 or air or electric gun is used to rotate the hollow member 338 in a counter-clockwise direction so that the hollow member 338 moves in an axial direction away from the annular member 330 to diminish the force exerted by the annular member 330 on the second friction pad 308 to decrease the frictional forces between the first and second friction pads 306 and 308 and the ratchet wheel 304 and the frictional force between the first friction pad 306 and the back-up plates 294 to permit the backup plates 294 to rotate relative to the ratchet wheel 304 and therefore the shaft 272 to rotate in the counter-clockwise direction. Rotation of the ratchet wheel 304 is prevented by the locking pawl 312. If the force rotating the hollow member 33 in the counter-clockwise direction is removed and a force is placed on the swivel snaphook 164 to rotate the shaft 272, the frictional engagement between the annular member 330 and the second friction pad 308 causes rotational movement between the hollow member 338 and the another end portion 290 to move the hollow member 338 in an axial direction toward the annular member 330 and increases the force exerted by the annular member 330 against the second friction pad 308 so that the frictional forces of the first and second friction pads 306 and 308 against the ratchet wheel 304 are increased and the frictional force between the first friction pad 306 and the back-up plates 294 is increased and, since the locking pawl 312 prevents rotation of the ratchet wheel in the counter-clockwise direction, the rotation of the 272 is stopped.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A fall arresting apparatus comprising:

a shaft mounted at a relatively fixed axial location to permit rotation thereof in a clockwise direction or a counter-clockwise direction;

drive means mounted on said shaft so that rotation of said drive means rotates said shaft in one of said clockwise or counter-clockwise directions;

holding means for preventing rotation of at least a portion of said drive means in the opposite of said one of said clockwise or counter-clockwise directions;

arresting means for applying a force to rotate said drive means and for permitting controlled rotation of said drive means in the opposite of said one of said clockwise or counter-clockwise directions but arresting uncontrolled rotation of said drive means in the opposite said one of said clockwise or counter-clockwise directions; and control means mounted for axial movement on said shaft for automatically controlling the operation of said arresting means.

2. The invention as in claim 1 and further comprising:

coupling means for coupling together said arresting means and said drive means for said movement in said one of said clockwise or counter-clockwise directions.

3. The invention as in claim 2 wherein said coupling means comprise:

force applying means for applying a force on at least a portion of said arresting means.

4. The invention as in claim 1 wherein said control means comprise:

an annular member having a longitudinal axis and mounted on said shaft for permitting rotational and axial movement therebetween;

said annular member located to contact at least a portion of said arresting means and apply a force thereto;

a hollow member;

a mounting means for mounting said hollow member on said shaft for permitting rotational and axial movement therebetween;

joining means for joining together said hollow member and said annular member for movement together;

resilient means in contact with said annular member and said hollow member so that said axial movement of said hollow member changes said force applied by said hollow member on said arresting means.

5. The invention as in claim 4 wherein said arresting means comprise:

at least a first friction pad mounted on said shaft for permitting relative rotational and axial movement therebetween;

a ratchet wheel mounted on said shaft for permitting relative rotational and axial movement therebetween and located so that said first friction pad is located between said ratchet wheel and said drive means; and at least a second friction pad mounted on said shaft for permitting relative rotational an axial movement therebetween and located between said ratchet wheel and said annular member so that said annular member, when moved in one axial direction by said resilient means, moves facing surfaces of said annular member, said second friction pad, said ratchet wheel, said first friction pad and said drive means into contacting pressurized relationship.

6. The invention as in claim 5 wherein said mounting means comprise:

an internally threaded portion in said hollow member; and an externally threaded portion on said one end portion.

7. The invention as in claim 6 wherein:

said resilient means applying a force on said annular member to move said annular member into contact with said second frictional pad to produce a frictional force therebetween so that rotation of said second frictional pad in said opposite of said one of said clockwise or counter-clockwise directions rotates said annular member to move said annular member and said hollow member in the opposite axial direction to decrease the force applied by said resilient means on said annular member.

8. The invention as in claim 7 and further comprising:

stop means for limiting the axial movement of said hollow member in said opposite direction.

9. The invention as in claim 4 and further comprising:

said annular member having at least one radially extending surface facing said hollow member;

an annular recess formed in said at least one radially extending surface;

said hollow member having at least one radially extending surface facing said annular member;

an annular recess formed in said at least one radially extending surface of said hollow member; and said resilient means located between said annular member and said hollow member and having end portions located in said annular recesses.

10. The invention as in claim 4 wherein said joining means comprise:

at least one axially extending pin on said annular member and extending therefrom in a direction toward said hollow member;

at least one axially extending opening in said hollow member; and at least a portion of said pin being located in said recess when said annular member and said hollow member are on said shaft.

11. The invention as in claim 4 wherein said joining means comprise:

at least a pair of spaced apart axial extending pins on said annular member and extending in a direction toward said hollow member;

at least a pair of spaced apart openings in said hollow member; and at least a portion of said pins being located in said openings when said annular member and said hollow member are on said shaft.

12. Apparatus for limiting the amount of force placed on line means of a hoist comprising:

a housing mounted at a fixed location;

a fixed axle mounted at a fixed location on said housing;

a drum having a center section and two end walls;

line means attached at a first end to said drum for being wound onto or unwound from said drum, said line means being attached at a second end to a load supporting device;

mounting means for mounting said drum for rotation on said fixed axle;

clutch means mounted on said mounting means for applying a force to rotate said drum;

rotatable means operatively connected to said clutch means for applying a limited force thereto to rotate said clutch means;

drive means for rotating said rotatable means; and force applying means for applying a force on said clutch means and said rotatable means to provide for rotation of said clutch means and said rotatable means together and to provide for relative rotation between said rotatable means and said clutch means when a force, equivalent to that produced by the force applying means, is applied to said load supporting device.

13. The invention as in claim 12 and further comprising:

fall arresting apparatus mounted in said housing.

14. The invention as in claim 13 wherein said fall arresting apparatus comprises:

a shaft mounted at a relatively fixed axial location to permit rotation thereof in a clockwise direction or a counter-clockwise direction;

drive means mounted on said shaft so that rotation of said drive means rotates said shaft in one of said clockwise or counter-clockwise directions;

holding means for preventing rotation of at least a portion of said drive means in the opposite of said one of said clockwise or counter-clockwise directions;

arresting means for applying a force to rotate said drive means and for permitting controlled rotation of said drive means in the opposite of said one of said clockwise or counter-clockwise directions but arresting uncontrolled rotation of said drive means in the opposite said one of said clockwise or counter-clockwise directions; and control means mounted for axial movement on said shaft for automatically controlling the operation of said arresting means.

15. The invention as in claim 14 and further comprising:

coupling means for coupling together said arresting means and said drive means for said movement in said one of said clockwise or counter-clockwise directions.

16. The invention as in claim 15 wherein said coupling means comprise:

force applying means for applying a force on at least a portion of said arresting means.

17. The invention as in claim 14 wherein said control means comprise:

an annular member having a longitudinal axis and mounted on said shaft for permitting rotational and axial movement therebetween;

said annular member located to contact at least a portion of said arresting means and apply a force thereto;

a hollow member;

a mounting means for mounting said hollow member on said shaft for permitting rotational and axial movement therebetween;

joining means for joining together said hollow member and said annular member for movement together;

resilient means in contact with said annular member and said hollow member so that said axial movement of said hollow member changes said force applied by said hollow member on said arresting means.

18. The invention as in claim 17 wherein said arresting means comprise:

at least a first friction pad mounted on said shaft for permitting relative rotational and axial movement therebetween;

a ratchet wheel mounted on said shaft for permitting relative rotational and axial movement therebetween and located so that said first friction pad is located between said ratchet wheel and said drive means; and at least a second friction pad mounted on said shaft for permitting relative rotational and axial movement therebetween and located between said ratchet wheel and said annular member so that said annular member, when moved in one axial direction by said resilient means, moves facing surfaces of said annular member, said second friction pad, said ratchet wheel, said first friction pad and said drive means into contacting pressurized relationship.

19. The invention as in claim 18 wherein:

said resilient means applying a force on said annular member to move said annular member into contact with said second frictional pad to produce a frictional force therebetween so that rotation of said second frictional pad in said opposite of said one of said clockwise or counter-clockwise directions rotates said annular member to move said annular member and said hollow member in the opposite axial direction to decrease the force applied by said resilient means on said annular member.

20. Safety apparatus for noting the proximity of the end of the line means of a hoist comprising:

a housing mounted at a fixed location;

an axle mounted at a fixed location on said housing;

a drum mounted for rotation on said axle;

said drum having a center portion and two opposite end walls;

line means attached at a first end to said drum for being wound onto or unwound from said center portion of said drum, said line means being attached at a second end to a worker's safety harness;

said line means being wound on said center portion of said drum so that portions of said line means form a row on said center portion of said drum;

a plurality of rows of said line means on said center portion of said drum; and resilient means joining together two adjacent portions of the first row next adjacent to said center portion of said drum comprising a strip of metallic material extending around said two adjacent portions, passing through two spaced apart openings in said center portion and the ends thereof secured together.

* * * * *